United States Patent [19]

Bullis et al.

[11] 4,450,641

[45] May 29, 1984

[54] MAGAZINE FLOOR PLATE LATCH FOR BOLT ACTION RIFLES

[75] Inventors: Douglas E. Bullis, Ilion, N.Y.; Kurt Blumer, Salt Lake City, Utah

[73] Assignee: Remington Arms Company, Inc., Bridgeport, Conn.

[21] Appl. No.: 440,877

[22] Filed: Nov. 12, 1982

[51] Int. Cl.[3] ..... F41C 25/00

[52] U.S. Cl. ..... 42/6; 42/18

[58] Field of Search ..... 42/6, 18, 22, 50

[56] References Cited

U.S. PATENT DOCUMENTS

| | | | |
|---|---|---|---|
| 667,856 | 2/1901 | Wagner . | |
| 747,777 | 12/1903 | Ross | 42/18 |
| 1,290,845 | 1/1919 | Redfield | 42/18 |
| 1,464,864 | 8/1923 | Browning | 42/18 |
| 1,496,337 | 6/1924 | Feederle | 42/18 |
| 2,745,203 | 5/1956 | Ruple | 42/50 |
| 2,997,803 | 8/1961 | Florence | 42/18 |
| 3,574,264 | 4/1971 | Simmons, Sr. | 42/6 |
| 3,905,142 | 9/1975 | Haskell | 42/18 |
| 4,237,638 | 12/1980 | Trexler | 42/6 |

FOREIGN PATENT DOCUMENTS

| | | | |
|---|---|---|---|
| 277814 | 1/1970 | Austria | 42/6 |

*Primary Examiner*—Charles T. Jordan

*Attorney, Agent, or Firm*—Nicholas Skovran; William L. Ericson; Barry Estrin

[57] ABSTRACT

A magazine floor plate latch for releasing the hinged floor plate of a cartridge magazine in a bolt action firearm. A spring biased latch having two upper legs and one lower leg is positioned in a central aperture in the front face of a trigger guard. The latch is adapted to pivot about a pivot point at a line of contact between a pointed surface in the trigger guard extending upward and fitting into a notch formed in the lower leg of the latch. The latch is normally biased by a spring so that one of its upper legs blocks the floor plate to keep it from swinging open about its hinged end. The floor plate is released by applying pressure on the latch so that it pivots until this upper leg no longer blocks the plate. This upper leg has a curved locking surface with a center of curvature offset from the pivot point to enable the locking surface to relatch the floor plate tightly against the bottom of the magazine as the latch pivots to its normally spring biased position.

16 Claims, 5 Drawing Figures

MAGAZINE FLOOR PLATE LATCH FOR BOLT ACTION RIFLES

BACKGROUND OF THE INVENTION

1. Field of the Invention

This invention relates to cartridge magazines for firearms and more particularly to an improved floor plate latching system for the magazine floor plate in bolt action rifles.

2. Description of the Prior Art

In bolt action firearms, particularly repeating rifles, successive cartridges are chambered by a reciprocating bolt which strips the uppermost cartridge from a magazine and feeds the cartridge to the breech of the barrel for firing. Bolt action firearms generally comprise a receiver having a barrel threadedly secured to its forward end. The receiver and barrel assembly are mounted on a stock. A breech-bolt, positioned within the receiver, is adapted to reciprocate in the central bore of the receiver. The bolt slides on guide rails in the receiver and is rotated at its extreme forward movement to lock the bolt in its breech closed position. A bolt handle is connected to the rear portion of the bolt to slide and rotate the bolt into the breech closed position and to return it to the breech open position.

Aligned openings are provided at the top and bottom of the receiver. The top opening permits loading and ejecting of cartridges while the bottom opening allows cartridges to be fed from the magazine to the breech of the barrel by the forward movement of the bolt. The cartridge magazine is mounted in the stock below the receiver so as to be aligned with its bottom opening. The magazine comprises an open-ended box-like structure having side and end walls. The bottom of the magazine is closed off by a removable floor plate. The floor plate may be attached to the gunstock by screws, as shown in U.S. Pat. No. 3,905,142 to Phillip H. Haskell, issued Sept. 16, 1975 and assigned to the same assignee as the present application. Alternatively, the floor plate may be hinged at its forward end to the underside of the stock and may be provided with a spring loaded latch at its rear end which serves to hold the floor plate in its normal closed position, as shown in U.S. Pat. No. 2,745,203, issued to C. E. Ruple on May 15, 1956.

An elongated follower plate is located within the magazine and is biased upwardly toward the bottom opening in the receiver and the bolt by a magazine spring which bears against the floor plate and the bottom of the follower plate. The magazine is loaded by inserting cartridges through the top and bottom openings of the receiver onto the follower plate of the magazine in stacked relationship. The spring operates to urge the cartridges upward so that the uppermost cartridge will be in position to be fed by the forward movement of the bolt to the breech of the barrel.

To unload unfired cartridges from the magazine, the floor plate is removed. The hinged floor plate greatly facilitates such unloading since the floor plate swings down when unlatched to permit removal of the cartridges. Typically, the latch release is located immediately adjacent the rear of the floor plate under the stock, where it is depressed by a finger to unlatch the floor plate, as shown in the aforenoted Ruple patent. Other latch mechanisms are adapted to pivot about a pivot pin mounted in the receiver, the magazine or the trigger guard, as shown, for example, in U.S. Pat. No. 4,237,638 issued Dec. 9, 1980 to Gene D. Trexler; No. 3,574,264 issued Apr. 13, 1971 to Ernest P. Simmons, Sr.; No. 2,997,803 issued Aug. 29, 1961 to C. M. Florence; and No. 667,856 issued Feb. 12, 1901 to C. R. Wagner.

The latch release may be conveniently located adjacent to the forward portion of the trigger guard, as shown in the aforenoted Wagner and Florence patents. The latch release mechanisms described in these patents require the latch to pivot about a pivot pin located either in the latch plate or the trigger guard. An ideal location for the latch pivot point is along the front portion of the trigger guard, as shown in FIG. 11 of the Wagner patent. Use of a pivot pin through the trigger housing, however, is not desirable due to restricted space and physical appearance. Stamped trigger guards, for example, are not thick enough to support such a pivot pin.

BRIEF SUMMARY OF THE INVENTION

The present invention obviates the disadvantages of the prior art pivotable-type latch release mechanisms by eliminating the need for a pivot pin. The floor plate latch system of the present invention fits into the restricted area between the magazine and trigger housing assembly through the front face of the trigger guard. The latch is inserted through a space in the front face of the trigger guard and holds the floor plate against the bottom of the stock when the latch is in its latched position. A spring biases the latch to remain in this position. The latch is designed to pivot about a point on the trigger guard so that when pressure is exerted on the latch against the spring force, the latch will pivot rearward on the trigger guard point to release the floor plate and allow it to swing downward about its hinged forward end to release the cartridges in the magazine. The latch has a curved locking surface with a center of curvature offset from the pivot point to enable the locking surface to relatch the floor plate tightly against the bottom of the magazine as the latch pivots to its normally spring biased position.

The nature and novel features which are characteristic of the present invention, as well as the objects and advantages thereof, will become more apparent from consideration of the following description taken in connection with the accompanying drawings, in which:

DETAILED DESCRIPTION OF THE PREFERRED EMBODIMENTS

Figure 1:
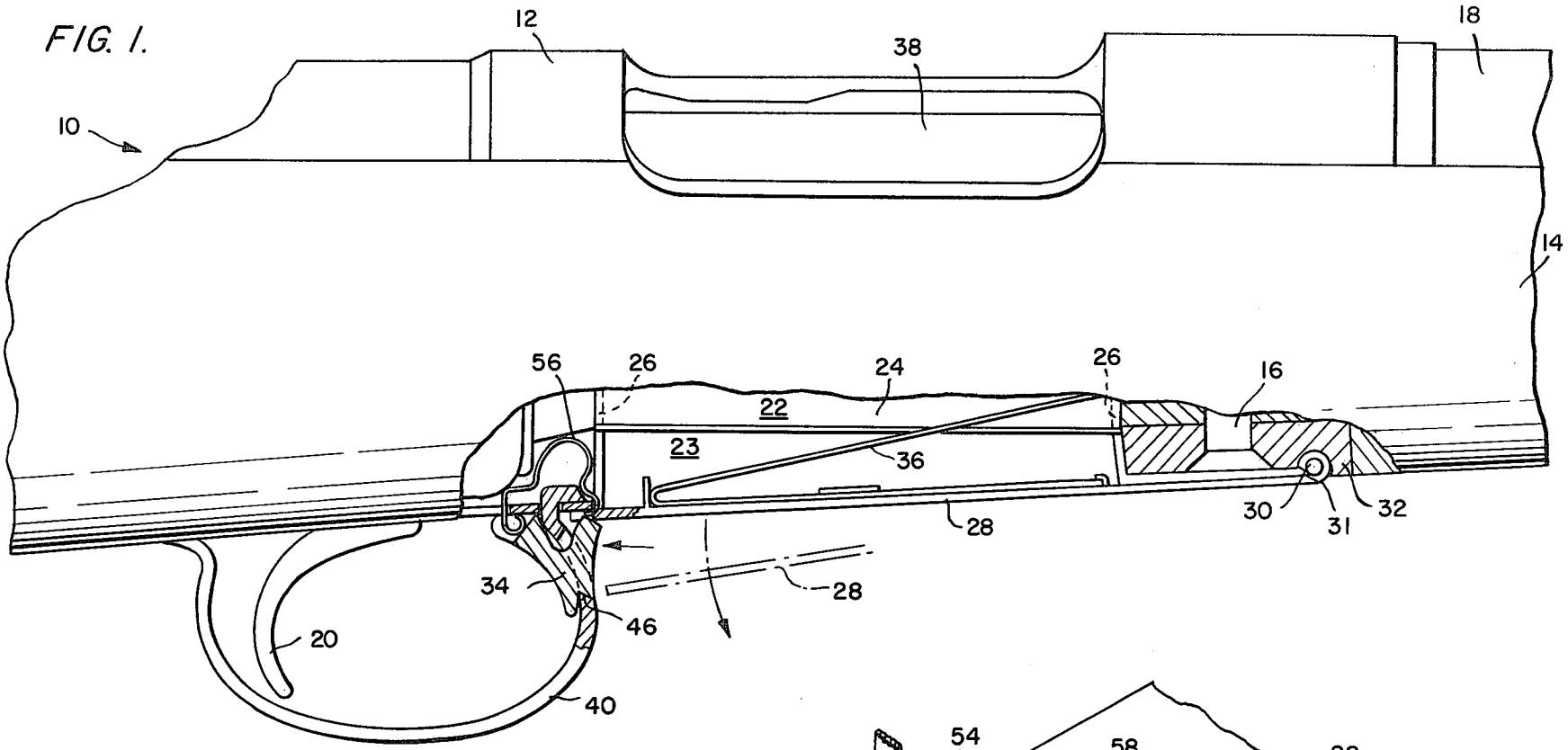
FIG. 1 is a fragmentary view in side elevation of a bolt action firearm illustrating a first embodiment of the magazine floor plate latch system of the present invention.

A fragmentary view of a bolt action rifle 10 incorporating the floor plate latch system of the present invention is illustrated in FIG. 1. Although the present invention is shown in a bolt action firearm, it will be appreciated that this invention is applicable to other firearms which have box magazines and hinged floor plates.

The rifle 10 shown in FIG. 1 comprises a receiver 12 attached to a stock 14 by means of screws 16. A barrel assembly 18 having a firing chamber or breech and a bore (not shown) is threaded to the forward end of the receiver. A breech bolt (not shown) having locking lugs at its forward end is positioned in the receiver 12 and is adapted to reciprocate in the central bore of the receiver into and out of breech closed position. A firing pin (not shown) is positioned in the bolt in a conventional, spring-biased manner. A trigger mechanism actuates the firing of the rifle by rearward pressure on the trigger 20 when a cartridge (not shown) has been chambered and the breech closed. A conventional bolt handle (not shown) is connected to the rear portion of the bolt to slide it forward and rotate the lugs to lock the bolt in the breech closed position, and thereafter to slide the bolt rearward to the breech open position.

Successive cartridges are chambered by the reciprocating bolt, which strips the uppermost cartridge from a magazine 22 and feeds the cartridge to the breech of the barrel for firing. The cartridge magazine 22 is mounted in the stock 14 below the receiver 12, and comprises an open-ended box-like structure having side walls 24 and end walls 26. In the embodiment shown in FIG. 1, the bottom of the magazine 22 abuts a floor plate base assembly 23 which forms a lower extension of the magazine. The bottom of the magazine extension is closed off by a hinged floor plate 28 which pivots at its forward hinged end about a pin 30 located within the hinged end 31 of the floor plate base assembly 23 within a curved recess of a floor plate pad 32. The rear end of the hinged floor plate 28 is adapted to be engaged by a spring-loaded latch 34 which serves to hold the floor plate in its normal closed position to the underside of the stock 14, and to unlatch the plate for unloading, as explained below.

An elongated follower plate (not shown) is located within the magazine 22 and is biased upward by a magazine spring 36 which bears against the floor plate 28 and the bottom of the follower plate. The magazine 22 is loaded by inserting cartridges through an opening 38 in the top of the receiver 12 and through another opening (not shown) at the bottom of the receiver onto the follower plate in stacked relationship. The magazine spring 36 operates to urge the cartridges upward so that the uppermost cartridge will be in position to be fed by the forward movement of the bolt to the breech of the barrel. When the bolt reciprocates rearward after firing, the fired cartridge casing is ejected through opening 38. During the succeeding forward stroke, the bolt strips the top cartridge from the magazine 22 and feeds it to the firearm chamber.

Figure 2:
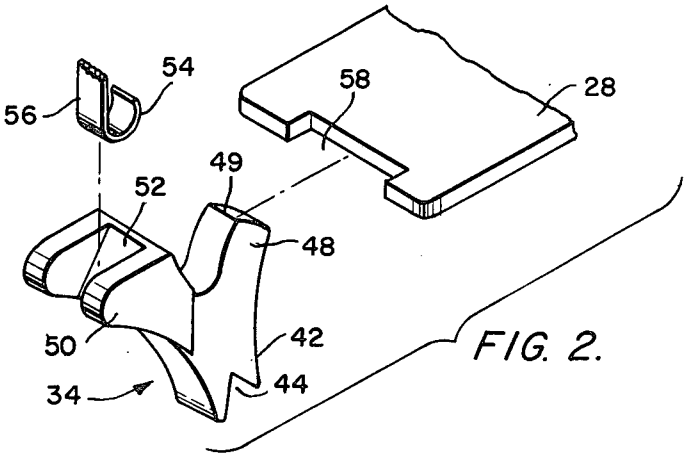
FIG. 2 is a fragmentary exploded view in perspective illustrating the latch, floor plate and latch spring of FIG. 1.

To unload unfired cartridges from the magazine 22, the floor plate 28 is unlatched by depressing the latch 34 rearward (in the direction shown by the arrow), allowing the floor plate 28 to swing down to permit removal of the cartridges. In the embodiment shown in FIGS. 1 and 2, the latch 34, which is approximately Y-shaped in cross-section, is inserted through a central opening in the front face of the trigger guard 40. The bottom leg 42 of the latch has an inverted V-shaped notch 44 which is adapted to rest upon and pivot about an edge 46 in the trigger guard 40 extending upward into the central opening. The upper right leg 48 of the latch 34 is positioned to engage the rear end of the floor plate 28. The upper left leg 50 is provided with a central notch 52 which is adapted to receive the curved end portion 54 of a latch spring 56.

The latch spring 56 biases the latch 34 so that its upper right leg 48 will normally block the hinged floor plate 28 so that it remains in its up position against the bottom of the stock 14. When a rearward pressure is exerted on the forward face of upper right leg 48, as shown by the arrow in FIG. 1, the latch 34 will pivot about the edge 46 in the trigger guard against the spring force exerted by the spring 56 until the leg 48 is aligned with a central recess 58 at the rear of the floor plate 28. This recess provides sufficient clearance to enable the floor plate to fall downward. The spring 56 will bias the latch to pivot forward when the pressure is removed. The floor plate is returned to its latched position simply by swinging it upward against the biased right leg 48 until it is again latched.

Figure 5:
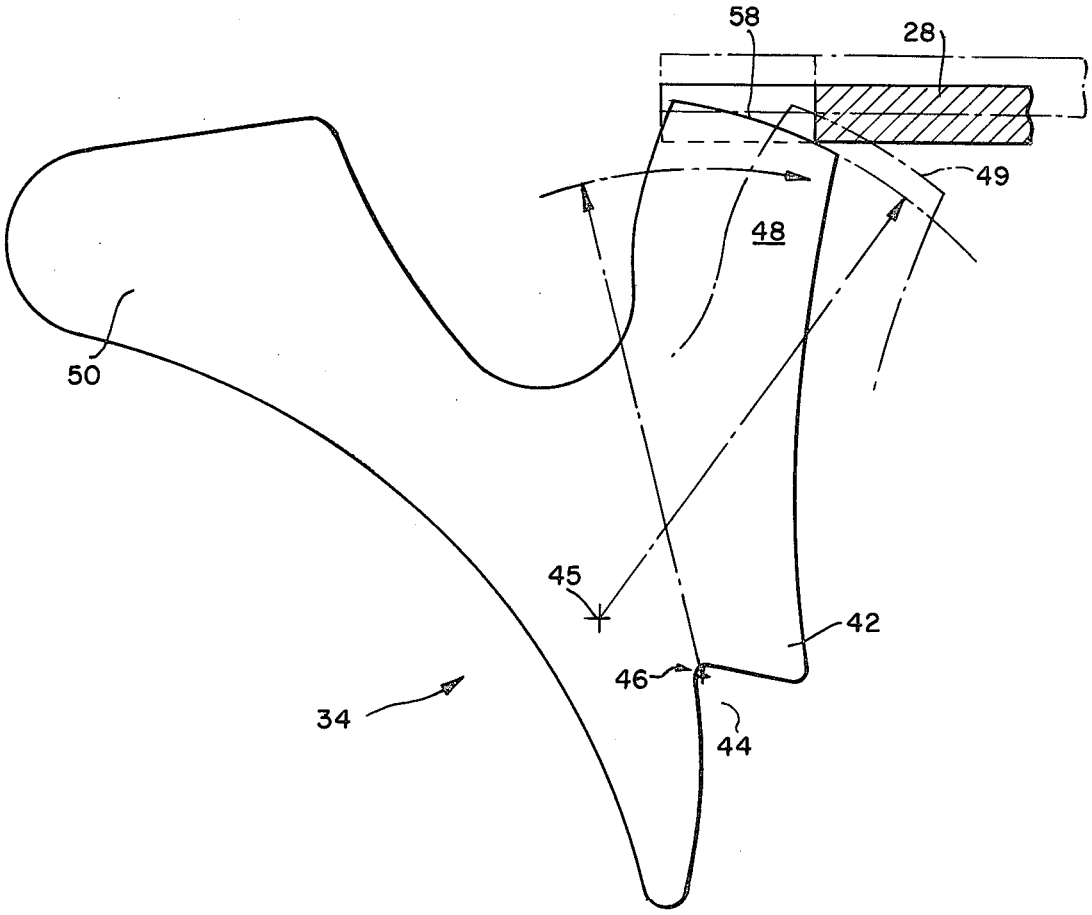
FIG. 5 is a schematic view illustrating the effect of the curved latch locking surface to relatch the floor plate as the latch pivots clockwise.

Relatching is facilitated by providing the right leg 48 with a curved locking surface 49, as shown in FIG. 5. The curved locking surface 49 has a center of curvature about a point 45 which is offset from the pivot point edge 46. This design permits the locking surface 49 to cam the end of the floor plate 28 within the central recess 58 upward to relatch the floor plate tightly against the bottom of the stock and magazine as the latch 34 pivots clockwise (in the direction of the arrow in FIG. 5) by the action of the spring on the left upper leg 50. Offsetting the center of curvature 45 from the pivot point 46 enables the end of the floor plate 28 to ride up smoothly on the curved locking surface 49 until it is latched tightly.

Figure 3:
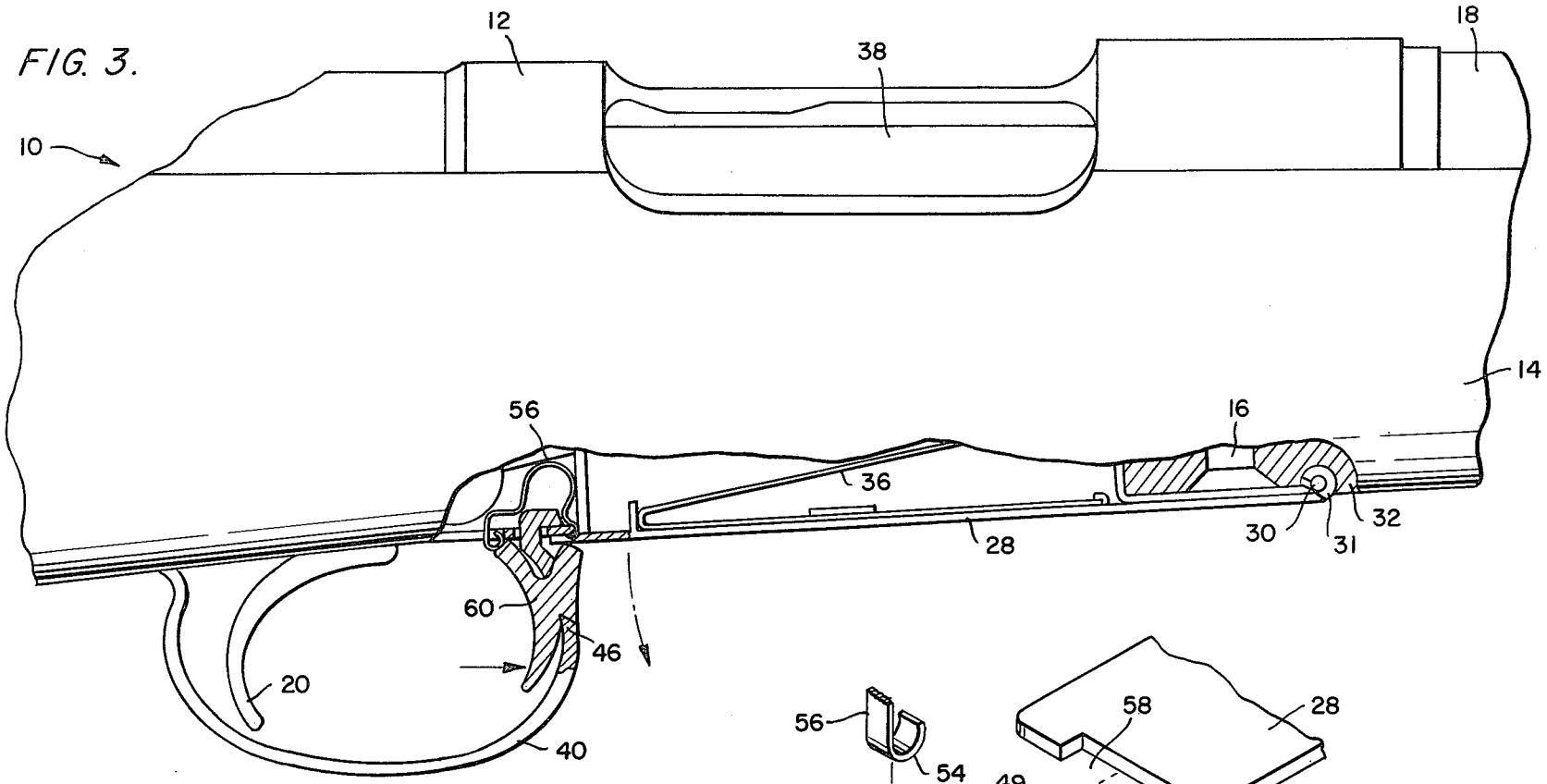
FIG. 3 is a fragmentary view in side elevation of a bolt action firearm illustrating a second embodiment of the magazine floor plate latch system of the present invention.
Figure 4:
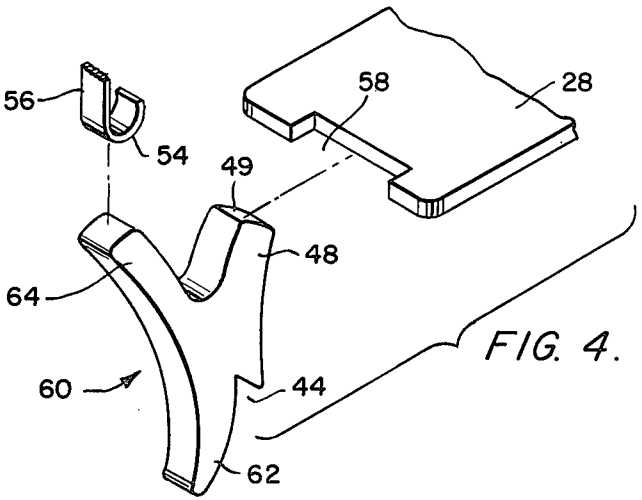
FIG. 4 is a fragmentary exploded view in perspective illustrating the latch, floor plate and latch spring of FIG. 3.

FIGS. 3 and 4, where like elements have the same reference numbers, illustrate a modified version of the latching mechanism. The latch 60 is similar to that shown in FIGS. 1 and 2, except that it has a longer bottom leg 62 extending downward along the inside of the trigger guard 40. Also, the upper left leg 64 does not have a central notch so that curved end portion 54 of the latch spring 56 bears directly against its top surface. The left leg 64 may, however, be provided with this notch, in which case it will be similar to the left leg 50 described above.

In the modified latch 60 of FIGS. 3 and 4, forward pressure is exerted against the bottom leg 62 to pivot the latch about the edge 46 in the trigger guard 40 to unlatch the floor plate 28. The operation of the latch 60 is otherwise identical to that described below.

While the particular embodiments of the invention have been described for purposes of illustration, it will be understood that various changes and modifications can be made therein within the spirit of the invention, and the invention accordingly is not to be taken as limited except by the scope of the appended claims.

We claim:

1. In a firearm having a receiver and a barrel secured to a stock, a cartridge magazine located in the stock below said receiver, and a trigger surrounded by a trigger guard mounted below the stock adjacent to the bottom of the magazine, said cartridge magazine being open at the top to permit cartridge loading through an opening in the receiver and cartridge feeding from the magazine, the bottom of said magazine being normally closed by a removable floor plate adapted to pivot about its forward end, said plate supporting a magazine spring which urges loaded cartridges upward toward the receiver, said firearm further including means for releasing the floor plate to unload the magazine comprising a latch positioned in a central aperture in the front face of said trigger guard, said latch being adapted to pivot about a trigger guard pivot point at a line of contact between the trigger guard and a bottom portion of the latch, and a latch spring bearing upon said latch so that the latch normally blocks the floor plate to maintain the plate against the bottom of the magazine, said floor plate being released by application of pressure on the latch against the spring force so that the latch will pivot until it no longer blocks the rear end of the floor plate, thus permitting the plate to swing downward about its forward end.

2. The firearm of claim 1, wherein the latch further comprises first and second upper legs and a lower leg, said latch spring bearing upon the first upper leg to bias the latch so that the second upper leg blocks the rear end of the floor plate.

3. The firearm of claim 2, wherein the trigger guard includes a pointed surface which extends upward into the aperture and fits into a notch formed in the lower leg of the latch, the line of contact between said notch and the pointed surface forming said trigger guard pivot point.

4. The firearm of claim 2, wherein the first upper leg of said latch is provided with a recess adapted to receive one end of the latch spring.

5. The firearm of claim 2, wherein pressure is exerted rearward against the second upper leg to pivot said latch about the trigger guard pivot point and release the floor plate.

6. The firearm of claim 3, wherein the lower leg of said latch includes a portion extending downward along the inside of the trigger guard below said pivot point so that the floor plate may be released by applying pressure forward against said downward extending portion to pivot the latch about the trigger guard pivot point.

7. The firearm of claim 2, wherein the second upper leg includes a curved locking surface having a center of curvature offset from the pivot point to enable the locking surface to relatch the floor plate tightly as the latch is pivoted by the spring force to its locked position.

8. The firearm of claim 2, wherein the floor plate includes a recessed portion at its rear end which provides clearance to enable the floor plate to fall downward when the latch has been pivoted until the second upper leg is aligned with said recessed portion.

9. A cartridge magazine floor plate assembly for a firearm having a stock and a receiver comprising:

a box-like magazine mounted in the stock below the receiver of the firearm;

a removable floor plate located along the bottom of the stock to close the bottom of the magazine, said floor plate adapted to pivot about a hinge at its forward end to open the bottom of the magazine for unloading;

a trigger surrounded by a trigger guard mounted below said stock adjacent to the rear end of the floor plate, said trigger guard having a central aperture in its front face; and a floor plate latch mounted in said trigger guard aperture and adapted to pivot about a trigger guard pivot point at a line of contact between the trigger guard and a bottom portion of the latch, said latch being spring biased so that the latch normally blocks the floor plate to maintain the plate against the bottom of the magazine, said floor plate being released by application of pressure on the latch against its spring force so that the latch will pivot until it no longer blocks the rear end of the floor plate, thus permitting the plate to swing downward about its hinged forward end.

10. The floor plate assembly of claim 9, wherein the floor plate latch further comprises first and second upper legs and a lower leg, and further comprising a latch spring bearing on the first upper leg to bias the latch so that the second upper leg blocks the rear end of the floor plate.

11. The floor plate assembly of claim 10, wherein the trigger guard includes a pointed surface which extends upward into the aperture and fits into a notch formed in the lower leg of the latch, the line of contact between said notch and the pointed surface forming said trigger guard pivot point.

12. The floor plate assembly of claim 10, wherein the first upper leg of said latch is provided with a recess adapted to receive one end of the latch spring.

13. The floor plate assembly of claim 10, wherein pressure is exerted rearward against the second upper leg to pivot said latch about the trigger guard pivot point and release the floor plate.

14. The floor plate assembly of claim 11, wherein the lower leg of said latch includes a portion extending downward along the inside of the trigger guard below said pivot point so that the floor plate may be released by applying pressure forward against said downward extending portion to pivot the latch about the trigger guard pivot point.

15. The floor plate assembly of claim 10, wherein the floor plate includes a recessed portion at its rear end which provides clearance to enable the floor plate to fall downward when the latch has been pivoted until the second upper leg is aligned with said recessed portion.

16. The floor plate assembly of claim 10, wherein the second upper leg includes a curved locking surface having a center of curvature offset from the pivot point to enable the locking surface to relatch the floor plate tightly as the latch is pivoted by the spring force to its locked position.

* * * * *